US010254052B2

(12) United States Patent
Sispera et al.

(10) Patent No.: US 10,254,052 B2
(45) Date of Patent: Apr. 9, 2019

(54) S-BENT TUBE COOLER

(71) Applicant: VISTEON GLOBAL TECHNOLOGIES, INC., Van Buren Township, MI (US)

(72) Inventors: Petr Sispera, Uhersky Ostroh (CZ); Andreas Capelle, Pulheim (DE); Peter Diehl, Cologne (DE); Stojan Cucuz, Cologne (DE); Bernd Homeyer, Edemissen (DE); Petr Stepka, Lipov (CZ)

(73) Assignee: HANON SYSTEMS, Daejeon-si (KR)

( * ) Notice: Subject to any disclaimer, the term of this patent is extended or adjusted under 35 U.S.C. 154(b) by 525 days.

(21) Appl. No.: 13/951,870

(22) Filed: Jul. 26, 2013

(65) Prior Publication Data

US 2014/0027099 A1 Jan. 30, 2014

(30) Foreign Application Priority Data

Jul. 26, 2012 (DE) ..... 10 2012 106 782

(51) Int. Cl.
*F28D 1/02* (2006.01)
*F28D 1/03* (2006.01)
(Continued)

(52) U.S. Cl.
CPC ..... *F28F 1/00* (2013.01); *F02M 26/32* (2016.02); *F28D 7/087* (2013.01); *F28F 1/02* (2013.01);
(Continued)

(58) Field of Classification Search
CPC ..... F28F 27/02; F28F 9/00; F28F 3/12; F28F 9/007; F28F 1/00; F28F 1/02; F28F 1/08;
(Continued)

(56) References Cited

U.S. PATENT DOCUMENTS 99,573 A * 2/1870 Johnson ..... F28F 9/22 165/160
2,371,096 A * 3/1945 Zipeto ..... F24H 1/34 122/356
(Continued)

FOREIGN PATENT DOCUMENTS

DE 1551820 A1 3/1970
DE 102004061673 A1 7/2006
(Continued)

*Primary Examiner* — Keith M Raymond
*Assistant Examiner* — Gustavo A Hincapie Serna
(74) *Attorney, Agent, or Firm* — Shumaker, Loop & Kendrick, LLP; James D. Miller

(57) ABSTRACT

The present invention relates to a heat exchanger for exhaust gas cooling, in particular for motor vehicles. The heat exchanger includes a flow duct which is formed from heat exchange tubes being arranged in parallel to one another, and through which the exhaust gas to be cooled can flow and around which a liquid coolant can flow, and secondly includes a housing having a housing wall and tube bottoms. The housing wall and the tube bottoms delimit a flow chamber for the coolant. The heat exchange tubes being arranged so as to form a tube bundle are formed with straight sections and deflection zones, wherein the heat exchange tubes in at least two deflection zones sweep an angle of at least 90°.

18 Claims, 5 Drawing Sheets

(51) Int. Cl.

| | |
|---|---|
| ***F28D 7/08*** | (2006.01) |
| ***F28F 1/00*** | (2006.01) |
| ***F28F 1/02*** | (2006.01) |
| ***F28F 1/08*** | (2006.01) |
| ***F28F 1/42*** | (2006.01) |
| ***F28F 9/22*** | (2006.01) |
| ***F02M 26/32*** | (2016.01) |

(52) U.S. Cl.
CPC ..... *F28F 1/08* (2013.01); *F28F 1/426* (2013.01); *F28F 9/22* (2013.01); *F28D 1/02* (2013.01); *F28D 1/0246* (2013.01); *F28D 1/0358* (2013.01); *F28D 2001/0273* (2013.01)

(58) Field of Classification Search
CPC .... F28F 1/426; F28D 7/02; F28D 7/10; F28D 15/00; F28D 1/02; F28D 1/0477; F28D 1/05341; F28D 7/087
USPC ..... 165/103, 157, 163, 159, 160, 100
See application file for complete search history.

(56) References Cited

U.S. PATENT DOCUMENTS

| | | | | |
|---|---|---|---|---|
| 6,718,956 | B2 * | 4/2004 | Klipfel | F28D 7/1669 123/568.12 |
| 7,032,577 | B2 * | 4/2006 | Rosin et al. | 123/568.12 |
| 8,522,537 | B2 * | 9/2013 | Lee | F01M 5/001 60/298 |
| 8,554,407 | B2 * | 10/2013 | Meisner | F01N 5/025 701/36 |
| 8,794,299 | B2 * | 8/2014 | Barfknecht | F28D 7/1692 165/41 |
| 2006/0032613 | A1 * | 2/2006 | Brost | F28D 7/1684 165/103 |
| 2008/0110595 | A1 * | 5/2008 | Palanchon | 165/103 |
| 2008/0289804 | A1 * | 11/2008 | Baumann | F28D 7/1692 165/157 |
| 2009/0013676 | A1 * | 1/2009 | Capelle et al. | 60/320 |
| 2009/0014151 | A1 | 1/2009 | Capelle et al. | |
| 2009/0032212 | A1 * | 2/2009 | Dogan | F02B 29/0462 165/41 |
| 2009/0056909 | A1 * | 3/2009 | Braun | 165/54 |
| 2009/0288404 | A1 | 11/2009 | Lempa et al. | |
| 2010/0243208 | A1 * | 9/2010 | Kar et al. | 165/96 |
| 2010/0243220 | A1 | 9/2010 | Geskes et al. | |
| 2010/0263610 | A1 * | 10/2010 | Mercz | F16K 1/222 123/41.09 |
| 2011/0094483 | A1 * | 4/2011 | Suh | F01M 5/001 123/568.12 |
| 2012/0017575 | A1 * | 1/2012 | Sloss | F01N 5/02 60/320 |
| 2013/0146263 | A1 * | 6/2013 | Kim | F28D 7/0041 165/155 |
| 2013/0312717 | A1 * | 11/2013 | Martin | F01N 5/02 123/568.16 |

FOREIGN PATENT DOCUMENTS

| | | | |
|---|---|---|---|
| DE | 102007054913 | A1 | 8/2008 |
| DE | 102008002430 | A1 | 1/2009 |
| DE | 102007054953 | A1 | 5/2009 |
| DE | 102008024569 | A1 | 12/2009 |
| GB | 1177532 | | 1/1970 |
| JP | 5237339 | A | 8/1977 |
| JP | 3058784 | U | 3/1999 |
| JP | 11241891 | A | 9/1999 |
| JP | 2004257366 | A | 9/2004 |
| JP | 2005201622 | A | 7/2005 |
| JP | 2008121658 | A | 5/2008 |
| JP | 4431579 | B2 | 12/2009 |
| JP | 2011122818 | A | 6/2011 |
| WO | 2009142055 | A1 | 11/2009 |

* cited by examiner

S-BENT TUBE COOLER

CROSS-REFERENCE TO RELATED APPLICATION

This application claims priority to German Non-Provisional Patent Application Serial No. DE 10 2012 106 782.1 filed Jul. 26, 2012, hereby incorporated herein by reference in its entirety.

FIELD OF THE INVENTION

The present invention relates to a heat exchanger for exhaust gas cooling in motor vehicles. The heat exchanger features a flow duct being formed from heat exchange tubes which are arranged in parallel to one another, as well as a flow chamber being arranged around the flow duct. The flow chamber is delimited by a housing wall and tube bottoms.

BACKGROUND OF THE INVENTION

State of the art systems for exhaust gas recirculation in motor vehicles are known. With the aid of such systems, nitrogen oxides entrapped in the exhaust gases, in particular in the exhaust gases of diesel-powered motor vehicles, can be reduced and fuel consumption of gasoline-powered motor vehicles can be lowered. In generic systems of exhaust gas recirculation, either cooled or uncooled exhaust gas is added to the fresh air being drawn in by the engine.

During combustion at high temperatures, in particular when lean mixtures are employed in the partial-load operational range, environmentally harmful nitrogen oxides are created in the engines of motor vehicles. In order to reduce nitrogen oxide emissions, it is necessary to decrease the high temperature peaks and to reduce the amount of excess air during combustion. By means of the lower oxygen concentration of the fuel-air mixture, the speed of the combustion process and thus the maximum combustion temperatures are reduced. Both effects are attained by the mixture of a partial flow of the exhaust gas to the flow of fresh air which is drawn in by the engine.

In diesel-powered motor vehicles, apart from the reduction of the oxygen content and the temperature peaks during combustion, a system of exhaust gas recirculation also leads to a reduction of noise emissions. In gasoline-powered motor vehicles comprising an exhaust gas recirculation system, throttling losses are minimized.

However, the admixture of the recirculated exhaust gas flow at high temperatures leads to a reduction of the cooling effect and thus of the efficiency of the engine. In order to counteract said reductions, the exhaust gas is cooled in a so-called exhaust gas heat exchanger or exhaust gas recirculation cooler prior to admixture. In gasoline-powered motor vehicles, the additional cooling of the exhaust gas leads to an increase of the compression ratio of the air being supplied to the engine.

Embodiments of exhaust gas heat exchangers are known. However, increasingly stringent legislation with respect to emission standards and consumption requirements for motor vehicles presuppose an increased cooling need in face of an ever-decreasing space requirement for the components in the vehicle. These conflicting requirements are only rarely fulfilled by known exhaust gas heat exchangers.

German Pat. No. DE 10 2007 054 953 A1 discloses an exhaust gas recirculation system of an internal combustion engine having an air-cooled exhaust gas recirculation cooler. The exhaust gas recirculation cooler, which is made of aluminum, features two-pass cooling tubes which lead into single-pass connection ports. By means of distributing the exhaust gas flow over two cooling tubes, the heat transfer surface is enlarged, thus resulting in an enhanced cooling capacity. The two-pass cooling tubes, which are additionally connected to one another via cooling fins, are wound three times in a U-shape.

German Pat. No. DE 10 2007 054 913 A1 describes a heat exchanger, in particular for a motor vehicle, having one or several flow ducts through which a fluid can flow. The flow ducts, which are provided in an extrusion profile, furthermore, at least in some sections feature a curved profile, in order to increase the heat transfer efficiency. According to one embodiment of the heat exchanger, the extrusion profiles are designed so as to be bent in a U-shape. A coolant flows around the outer walls of the extrusion profiles, while the exhaust gas flows along the inner wall.

In German Pat. No. DE 10 2008 024 569 A1 an exhaust gas cooler having a housing with a bypass duct and a cooling zone is disclosed. In the cooling zone, an exhaust gas cooling duct is disposed, which is formed by straight cooling tubes and deflection chambers. The housing comprises a control member for controlling the exhaust gas flow either by means of the bypass duct or else by means of the cooling zone. The exhaust gas flow is deflected during passage through the cooling zone, wherein the exhaust gas cooling duct features an inlet cooling duct, an adjoining deflection duct and an outlet cooling duct in turn adjoining the deflection duct. The exhaust gas flow thereby flows in the deflection duct counter to the flow direction of the inlet or outlet cooling duct. The exhaust gas flow to be cooled is directed at least four times through the cooling zone of the housing. The coolant flows around the cooling tubes, while the exhaust gas flows through the cooling tubes.

The exhaust gas recirculation systems known in the art comprise gas/gas and gas/water heat exchangers, wherein the gas/water heat exchangers are formed in particular as tube bundle heat exchangers, which in turn are embodied as pure I-flow or U-flow exhaust gas heat exchangers. The pure I-flow heat exchangers with the arrangement of the gas inlet and the gas outlet along one line, exhibit low pressure losses at the exhaust gas side, however, along with a low cooling capacity. In the U-flow exhaust gas heat exchangers, the gas inlet and the gas outlet are arranged on one side of the heat exchanger. As a result of the exhaust gas flowing out of the tubes into deflection chambers and subsequently into the tubes, however, high pressure losses occur on the exhaust gas side when a good cooling capacity is to be realized.

SUMMARY OF THE INVENTION

It is an object of the present invention to provide a heat exchanger for exhaust gas cooling in motor vehicles, which enables a high thermal efficiency and a high cooling capacity simultaneously with a low pressure loss of the exhaust gas. The heat exchanger is supposed to be space-saving by means of a compact construction and is supposed to enable the greatest possible constructional degrees of freedom, such as manifold options for connecting the coolant as well as flexible exhaust gas side connection directions of the inlet and outlet sides of the exhaust gas.

According to an embodiment of the invention, the object is attained by means of a heat exchanger for exhaust gas cooling, in particular for motor vehicles, comprising a flow duct which is formed from heat exchange tubes arranged in parallel to one another, and a housing having a housing wall and tube bottoms. The exhaust gas to be cooled can flow through the flow duct and a liquid coolant flows around the flow duct. The housing wall together with the tube bottoms encloses and delimits a flow chamber for the coolant.

The heat exchange tubes are arranged so as to form a tube bundle including straight sections and deflection zones, which in the direction of flow, preferably are arranged successively. The heat exchanger thereby is formed with at least two deflection zones of the heat exchange tubes.

According to an embodiment of the invention, the heat exchange tubes each sweep an angle of at least 90° in the deflection zones. The ends of the heat exchange tubes thus are aligned in the deflection zones so as to be offset from one another at least by 90°. The straight tube sections being arranged in the direction of flow upstream and downstream of a deflection zone, hence are equally arranged at an angle with respect to one another at least by 90° but not exceeding 180°.

The number of the deflection zones of the heat exchange tubes on the one hand makes it possible to vary the operability of the heat exchanger and on the other hand the relative arrangement of the exhaust gas inlet relative to the exhaust gas outlet and the directions of flow of the exhaust gas through the exhaust gas inlet towards the exhaust gas outlet.

Forming the deflection zones at an angle of 180° to be swept by the heat exchange tubes makes it possible to realize multi-pass heat exchangers as a function of the number of deflections. Forming the heat exchanger with a deflection, for example, leads to a U-flow of the exhaust gas, while two deflections lead to an S-flow and three deflections lead to a W-flow.

According to another embodiment of the invention, the straight sections and the deflection zones of the heat exchange tubes are arranged with respect to one another in such a manner that each heat exchange tube is formed in an S-shape or else in a W-shape.

Increasing the number of flow ducts in the smallest possible space advantageously results in a highly compact heat exchanger with a high packing density and an enhanced heat transfer from the exhaust gas to the coolant. The exhaust gas inlet and the exhaust gas outlet are each arranged at a common side or on opposite sides of the heat exchanger.

Combining the deflection zones with an angle of 180° and 90° to be swept by the heat exchange tubes makes it possible to vary the relative arrangement of the exhaust gas inlet relative to the exhaust gas outlet. The alignment of the exhaust gas inlet and the exhaust gas outlet relative to one another can be realized with a high degree of flexibility.

A further development of the invention can be seen in that the heat exchange tubes are made of a metallic material, preferably stainless steel. The heat exchange tubes, in their capacity as continuous with multiple bent tubes, direct the exhaust gas from the exhaust gas inlet to the exhaust gas outlet of the heat exchanger. Directing the exhaust gas in continuous, uniform or uninterrupted tubes leads to a minimal pressure loss within the exhaust gas flow. Moreover, the deflection zones of the heat exchange tubes can be employed for heat transfer to the coolant, since the coolant flows around the heat exchange tubes also in the deflection zones, resulting in optimum utilization of the heat transfer area and the space available to the heat exchanger.

Instead of the bent shape as a deformation, alternatively, the tubes can also be composed of differently formed tube sections, which are preferably welded or soldered. Thereby, a straightly formed tube section is adjoined by a tube element featuring an arcuate deformation about an axis which is aligned perpendicularly with respect to the longitudinal axis of the tube. The head and the end of the bent tube element are arranged at an angle of at least 90° with respect to one another. Mechanical connections of the heat exchange tubes with further components of the heat exchanger, such as the tube bottoms, preferably are equally formed in a welded or soldered fashion.

According to another embodiment of the invention, the heat exchange tubes feature a contoured outer wall, in order to firstly enlarge the heat transfer area and secondly to influence the flow of the coolant and thus to enhance heat transfer. Thereby, according to an embodiment of the invention, the outer wall is formed with a surface having a groove being helically wound about the longitudinal axis, which either features a constant or a decreasing pitch. In another embodiment, the pitch is consequently non-constant.

According to an embodiment of the invention, the outer wall of the heat exchange tubes is formed with a surface having a crossed, double, or triple helical line, respectively a helix.

Forming the outer wall with a corrugated surface represents another embodiment. Said corrugations thereby can be arranged perpendicularly to the longitudinal axis of the heat exchange tube or can be arranged at an angle which deviates by 90° with respect to the longitudinal axis of the heat exchange tube. Thereby, the distance between the corrugations additionally can be constant or can vary.

According to a further embodiment of the invention, indentations or beads, are formed on the surface of the outer wall of the heat exchange tubes. In all embodiments of forming the surface of the outer wall, the outer diameter of the heat exchange tube is preferably constant. The outer diameter, however, can become larger or smaller in the direction of flow of the exhaust gas or the coolant. In this case, the outer diameter is non-constant.

According to another embodiment of the invention, the heat exchange tubes are either embodied as flat tubes having a substantially rectangular cross-section or are embodied as circular tubes having a substantially circular cross-section. The cross-section of the flat tubes can be formed along the boundary lines of the lateral faces, preferably in a rectangular, rounded or chamfered fashion. The cross-section of the circular tubes preferably exhibits a constant inner radius. The cross-section can also be designed, for example, in an oval configuration.

The heat exchanger can be formed with bypass tubes being arranged in parallel to one another for the purpose of directing uncooled exhaust gas past the area of the cooled flow duct. The bypass tubes are fluidly connected in parallel with respect to the heat exchange tubes. If cooling of the exhaust gases is not desirable or unnecessary such as when the internal combustion engine of the motor vehicle is started, the exhaust gas being introduced into the heat exchanger via the exhaust gas inlet is not directed through the heat exchange tubes but rather is directed through the bypass tubes, thus being directed past the heat exchange tubes. The exhaust gas inlet thereby includes an exhaust gas inlet adapter having two openings, wherein the first opening represents the exhaust gas inlet for introducing the exhaust gas into the heat exchanger and the heat exchange tubes, and the second opening represents the exhaust gas inlet for introducing the exhaust gas into the bypass tubes. The separation of the exhaust gas mass flow and the introduction of the same into the heat exchange tubes or bypass tubes can also be performed within the heat exchanger subsequent to the entry into the heat exchanger.

The exhaust gas mass flow thereby can be partially directed both through the heat exchange tubes as well as through the bypass tubes. Prior to the exit of the exhaust gas from the heat exchanger through the exhaust gas outlet, which includes only one opening, the exhaust gas mass partial flows are mixed again and the exhaust gas mass flow is directed out of the heat exchanger. The bypass tubes are configured so as to be thermally insulated.

According to another embodiment of the invention, the heat exchanger is formed with coolant flow directing means for directing the coolant. The coolant flow directing means divide the flow area of the coolant into ducts and direct the coolant along the outer wall of the heat exchange tubes from a coolant inlet up to a coolant outlet. The coolant flow directing means thereby are closely connected to the tube bottoms and direct the coolant along the frontal sides of the heat exchanger in such a manner that short-circuit flows in the sense of crossflows are prevented. Moreover, the coolant flow directing means, which are embodied as metal sheets, support the heat exchange tubes, direct the coolant to certain areas of the heat exchange tubes, and where required, alter the flow pattern of the coolant in order to additionally influence heat transfer.

The highly efficient exhaust gas cooler, for reducing harmful emissions in gasoline-powered engines and diesel-powered engines as well as for enhancing the efficiency of gasoline-powered engines, can be operated with a high cooling capacity simultaneously with a low pressure loss. The inventive solution entails further manifold advantages such as the following: smaller dimensioning or even omission of alternative nitrogen oxide reduction measures in diesel-powered vehicles and measures for lowering fuel consumption in gasoline-powered vehicles, thus enabling reduction of the vehicle weight; maximum thermal efficiency with a compact installation space and maximum cooling capacity with minimum space requirements; great degree of constructional freedom, such as flexible exhaust gas side connection devices of the inlet and outlet sides of the exhaust gas as well as the coolant connections; further reduction of fuel consumption; and increased reduction of nitrogen oxides in the exhaust gas.

BRIEF DESCRIPTION OF THE DRAWINGS

Further details, features and benefits of embodiments of the invention will emerge from the following description of sample embodiments with reference to the accompanying drawings. There are shown.

DETAILED DESCRIPTION OF EXEMPLARY EMBODIMENTS OF THE INVENTION

The following detailed description and appended drawings describe and illustrate various exemplary embodiments of the invention. The description and drawings serve to enable one skilled in the art to make and use the invention, and are not intended to limit the scope of the invention in any manner.

Figure 1A:
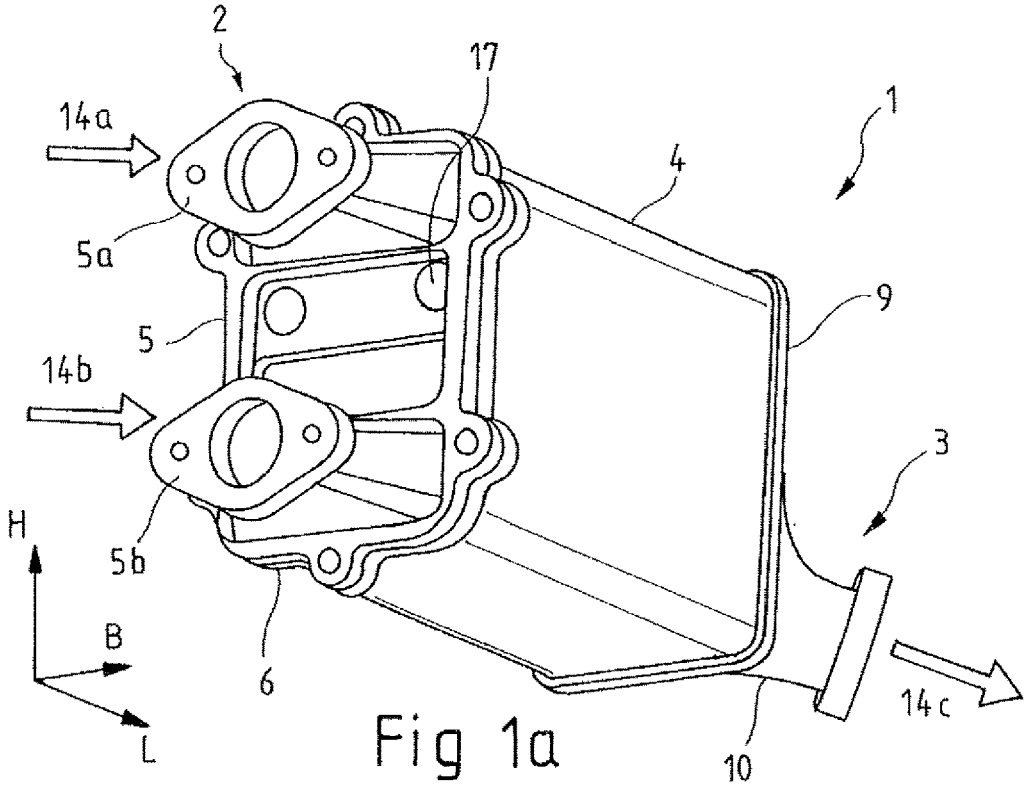
FIG. 1*a* shows an exhaust gas heat exchanger with a housing wall in a perspective view.
Figure 1B:
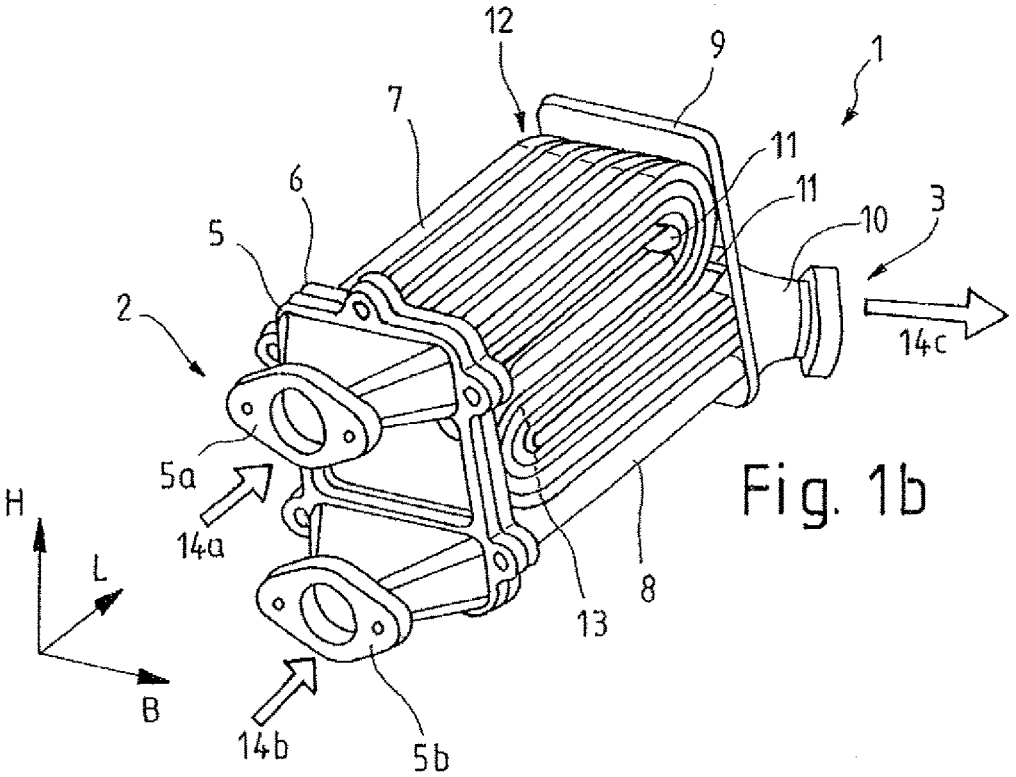
FIG. 1*b* shows an exhaust gas heat exchanger without a housing wall in a perspective view.

FIGS. 1*a* and 1*b* illustrate a heat exchanger 1 for exhaust gas cooling with an exhaust gas inlet 2 and an exhaust gas outlet 3, respectively in a perspective view. FIG. 1*b* thereby illustrates a view of the heat exchanger 1 without a housing wall 4 by depicting heat exchange tubes 7 which are bent in an S-shape.

The exhaust gas to be cooled flows through the heat exchange tubes 7, while the coolant absorbing the heat flows in the gap surrounding the heat exchange tubes 7 as well as in the gap between the heat exchange tubes 7 and the housing wall 4. The coolant is fed to the heat exchanger 1 via a coolant inlet 17. Coolant inlet tubes are not shown.

The heat exchange tubes 7 being arranged in a tube bundle extend from the exhaust gas inlet 2 without interruption up to the exhaust gas outlet 3. The tube bundle, along its length extension, is completely enclosed by the housing wall 4. The open ends of the heat exchange tubes 7 thereby, on the one hand, are aligned towards an exhaust gas inlet adapter 5 and, on the other hand, to an exhaust gas outlet adapter 10. The ends of the tubes are aligned in a longitudinal direction L in opposite directions and on different planes with respect to a height H and a width B of the heat exchanger 1.

The exhaust gas inlet adapter 5 is connected to the housing wall 4 via an exhaust gas inlet flange 6 and thus forms a terminal end of the heat exchanger 1 on the first frontal side. Here, the terminal end sides of the heat exchanger 1 in the longitudinal direction L are referred to as frontal sides. The second frontal side is closed by means of the exhaust gas outlet adapter 10.

The exhaust gas inlet adapter 5 has two exhaust gas inlets 5*a*, 5*b*. The exhaust gas mass flow entering the heat exchanger 1 through the first exhaust gas inlet 5*a* in the direction of a flow 14*a* directed through a diffuser and is subsequently distributed over the heat exchange tubes 7. Following, the alternative introduction of the exhaust gas mass flow in the direction of a flow 14*b* through the second exhaust gas inlet 5*b*, the exhaust gas flows through bypass tubes 8 to the exhaust gas outlet 3 without being tempered, i.e. without being cooled. Thereby, the heat exchange tubes 7 are not affected.

By means of a non-illustrated controller, it is possible to distribute the exhaust gas mass flow before entry into the heat exchanger 1 to the exhaust gas inlets 5*a*, 5*b*, hi order to direct a first part of the exhaust gas mass flow through the heat exchange tubes 7 and to thereby cool them down, while the second part of the exhaust gas mass flow is directed through the bypass tubes 8 and is not cooled down.

The exhaust gas mass partial flows of different temperatures are mixed again at the exhaust gas outlet 3 and exit the heat exchanger 1 through the exhaust gas outlet adapter 10 in the direction of a flow 14*c*. The bypass tubes 8 are configured to be thermally insulated in order to minimize or else prevent heat exchange with the environment and thus with the coolant flowing around the heat exchange tubes 7.

The coolant directed along the longitudinal extension of the heat exchange tubes 7 around the heat exchange tubes 7 is directed by means of a coolant flow directing means 11. The coolant flow directing means 11 which are formed as metal sheets divide the flow chambers surrounding the heat exchange tubes 7 into three different ducts and deflect the coolant at the frontal sides of the heat exchanger 1, such that the coolant can also flow in a first deflection zone 12 and a second deflection zone 13 surrounding the heat exchange tubes 7, and such that heat is transferred from the exhaust gas and the surface of the heat exchange tubes 7 to the coolant.

The ducts for directing the coolant at the frontal sides are delimited by an outlet tube bottom 9. One of the coolant flow directing means 11 thereby for instance rests against the outlet tube bottom 9 and seals the transition zone from the first into the second flow duct of the coolant, this means the first deflection zone 12 with respect to the third flow duct, in order to prevent short-circuit flows of the coolant, and thus to attain optimum heat transfer.

Figure 2:
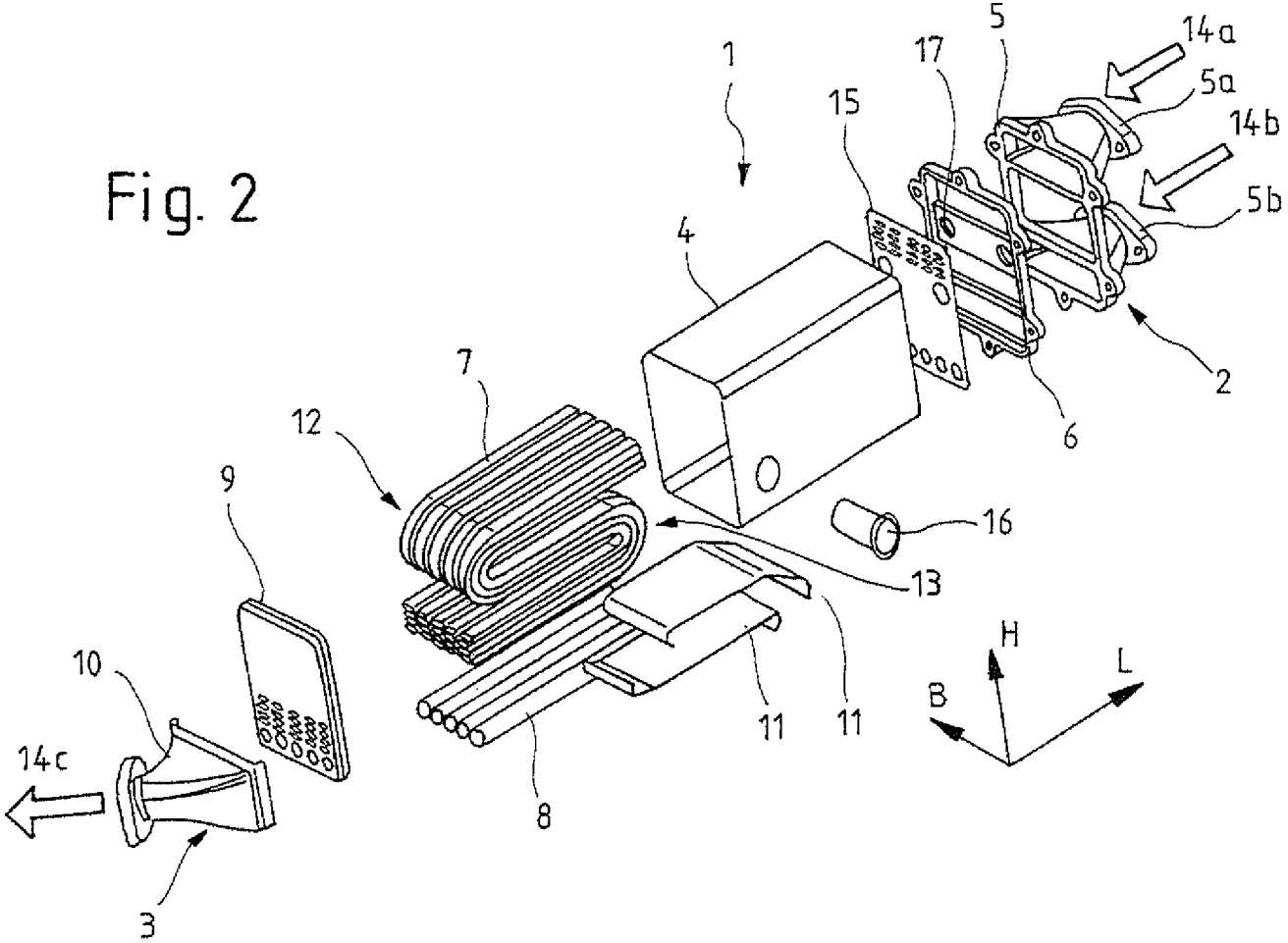
FIG. 2 shows an exhaust gas heat exchanger with 20 flat tubes bent in an S-shape in an exploded view.

FIG. 2 illustrates the heat exchanger 1 for exhaust gas cooling in an exploded view, wherein the embodiment comprises the heat exchange tubes 7 including a tube bundle made of 20 flat tubes which are bent in an S-shape.

The exhaust gas is introduced via the exhaust gas inlet adapter 5, through the exhaust gas inlets 5*a*, 5*h*, into the heat exchanger 1, passes through the heat exchange tubes 7 or the bypass tubes 8 and exits the heat exchanger 1 via the exhaust gas outlet adapter 10. The heat exchange tubes 7 as well as the bypass tubes 8 with their ends each held in the outlet tube bottom 9 and an inlet tube bottom 15, this means at the frontal sides of the heat exchanger 1. Thereby, the heat exchange tubes 7 and the bypass tubes 8 are soldered both to the outlet tube bottom 9 as well as to the inlet tube bottom 15.

The shape of the coolant flow directing means 11 is adapted to the configuration of the tube bundle of the heat exchange tubes 7 and the coolant flow directing means 11 divide the flow chamber of the coolant into three ducts. The ducts are thus delimited by the housing wall 4, the coolant flow directing means 11 and the tube bottoms 9, 15. Heat exchange tubes 7 are arranged within the ducts such that the coolant can flow in the ducts along the outside of the heat exchange tubes 7 and absorbs heat. The coolant flow directing means 11 are formed as metal sheets having rounded narrow sides, this means being bent by 90° about an axis which is arranged transversely to the longitudinal direction L, respectively in the direction of the width B. The shape of the narrow sides corresponds to the respective deflections of the continuously formed heat exchange tubes 7, such that the coolant is deflected in the deflection zones 12, 13 without any additional flow losses in the direction of flow. At the contact edges, the coolant flow directing means 11, which are preferably made of stainless steel or aluminum, are closely connected to the tube bottoms 9, 15. The close connection is ensured mechanically, for instance, by soldering or welding, or by means of an additional sealing. A flexible sealing thereby is embodied as a rubber lip or is made of silicone.

During assembly of the heat exchanger 1, the heat exchange tubes 7, which are firmly connected to the tube bottoms 9, 15 and the bypass tubes 8, are introduced into the housing wall 4 subsequent to fastening of the coolant flow directing means 11 in the gaps of the bent heat exchange tubes 7 with the inlet tube bottom 15 ahead. The outlet tube bottom 9 is formed with an edge, which encloses the housing wall 4 over the entire circumference. Subsequent to assembly, the edge rests against the outer surface of the housing wall 4. At the edge, the outlet tube bottom 9 and the housing wall 4 are connected to one another in a fluid-tight manner, for instance, by means of a mechanical connection such as by soldering or welding, and the housing is closed.

The exhaust gas inlet flange 6 is arranged at the frontal side of the exhaust gas inlet 2 so as to be firmly connected to the housing wall 4. The exhaust gas inlet flange 6 thereby can be soldered or else welded to the housing wall 4. Subsequent to assembly of the tube bundle with the tube bottoms 9, 15, the inlet tube bottom 15 rests against the exhaust gas inlet flange 6. The exhaust gas inlet adapter 5 is firmly connected to the exhaust gas inlet flange 6, for instance using a threaded connection. A non-illustrated sealing is arranged between the exhaust gas inlet adapter 5 and the exhaust gas inlet flange 6.

The exhaust gas outlet adapter 10 is fastened at the frontal side of the exhaust gas outlet 3 which is arranged opposite to the frontal side of the exhaust gas inlet 2 in the longitudinal direction L. Thereby, the exhaust gas outlet adapter 10 formed with a diffuser completely covers the openings of the heat exchange tubes 7 and the bypass tubes 8.

The coolant is introduced via the coolant inlet 17 at the frontal side of the exhaust gas inlet 2 into the heat exchanger 1 and flows through the heat exchanger 1 in the same direction of the flow 14*a* of the exhaust gas. The heat exchanger 1 thus is formed as a direct flow heat exchanger 1.

The heat exchanger 1 can also be operated as a counter flow heat exchanger as a function of the type of connection of the coolant inlet 17 and a coolant outlet 16. The coolant flows in the gaps of the heat exchange tubes 7 and the housing wall 4 as well as of the coolant flow directing means 11 up to the coolant outlet 16. The coolant outlet 16 is arranged laterally at the housing wall 4.

Figures 3, 4:
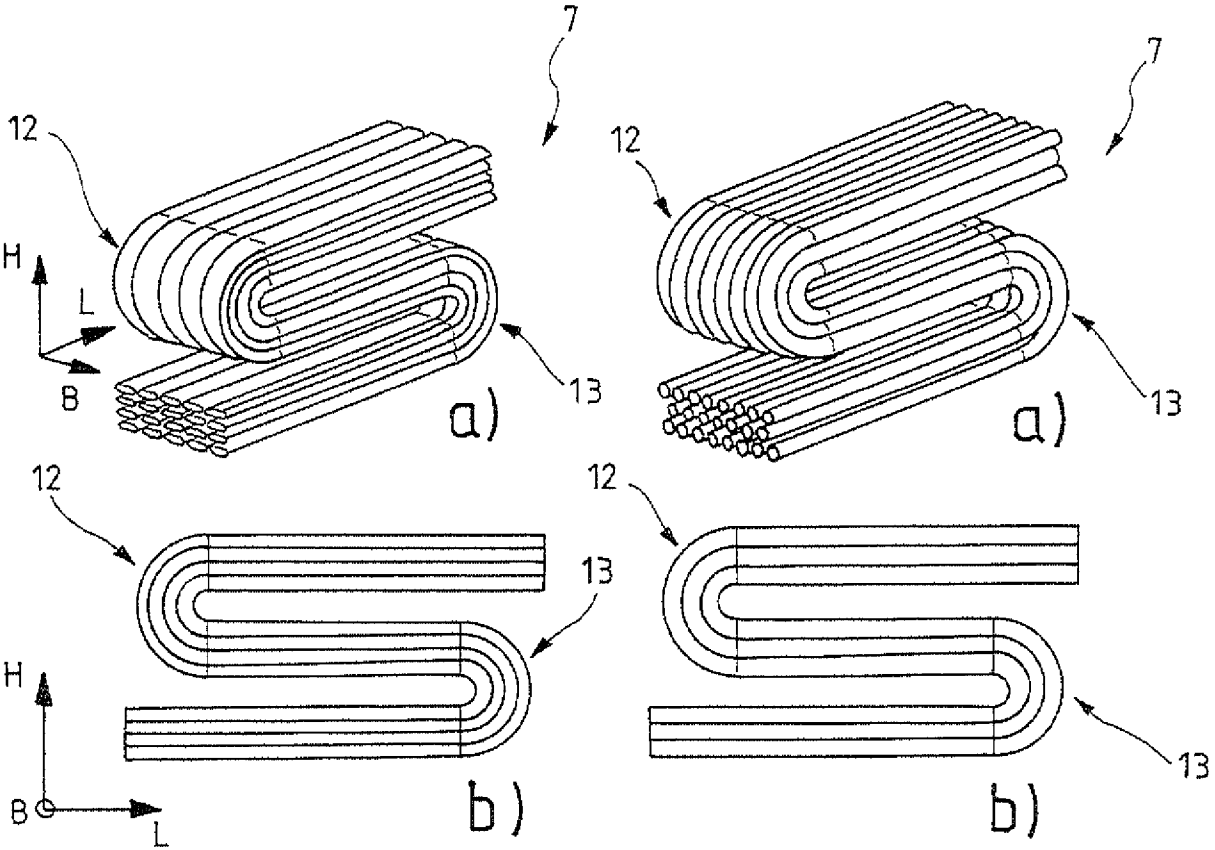
FIG. 3*a* shows a tube bundle made of 20 flat tubes bent in an S-shape in a perspective view.
FIG. 3*b* shows a tube bundle made of 20 flat tubes bent in an S-shape in a lateral view.
FIG. 4*a* shows a tube bundle made of 23 circular tubes bent in an S-shape in a perspective view.
FIG. 4*b* shows a tube bundle made of 23 circular tubes bent in an S-shape in a lateral view.

FIGS. 3*a*, 3*b*, 4*a* and 4*b* illustrate the tube bundles being made of 20 flat tubes bent in an S-shape and made of 23 circular tubes bent in an S-shape in individual views. FIGS. 3*a* and 3*b* illustrate the tube bundle made of 20 flat tubes bent in an S-shape, respectively in a perspective and in a lateral view.

The heat exchange tubes 7 are each arranged in parallel to one another over their entire length. At the ends, this means in the mounted state at the frontal sides of the heat exchanger 1, the heat exchange tubes 7 are each aligned flush with one another. The ends of the heat exchange tubes 7 thereby project beyond the respective adjacently arranged deflection zones 12, 13 in such a manner that the ends can be connected to the substantially even and straightly formed tube bottoms 9, 15 such that a gap remains between the vertexes of the deflections 12, 13 of the heat exchange tubes 7 and the tube bottoms 9, 15, wherein the gaps form a part of the flow chamber of the coolant.

As illustrated in FIG. 3*a*, the flat tubes are arranged both in the direction of the width B as well as the height H equidistantly one next to the other and one on top of the other. Thereby, a 5×4 matrix having five heat exchange tubes 7 in the width B and four heat exchange tubes 7 in the height H is obtained.

In contrast to the tube bundle made of the flat tubes, the heat exchange tubes 7 in the tube bundle according to FIG. 4*a* are arranged in a vertical direction, this means in the direction of height H, so as to be offset from one another. Thereby, the heat exchange tubes 7 are arranged in three horizontal planes, which are spanned by the width B and the length L. Two planes being externally positioned in the vertical direction each having eight circular heat exchange tubes 7, while in the intermediate plane, which is positioned between the external planes, seven circular heat exchange tubes 7 are arranged. The heat exchange tubes 7 are embodied as plain tubes, but alternatively can also be equipped with surface contours.

Figure 5:
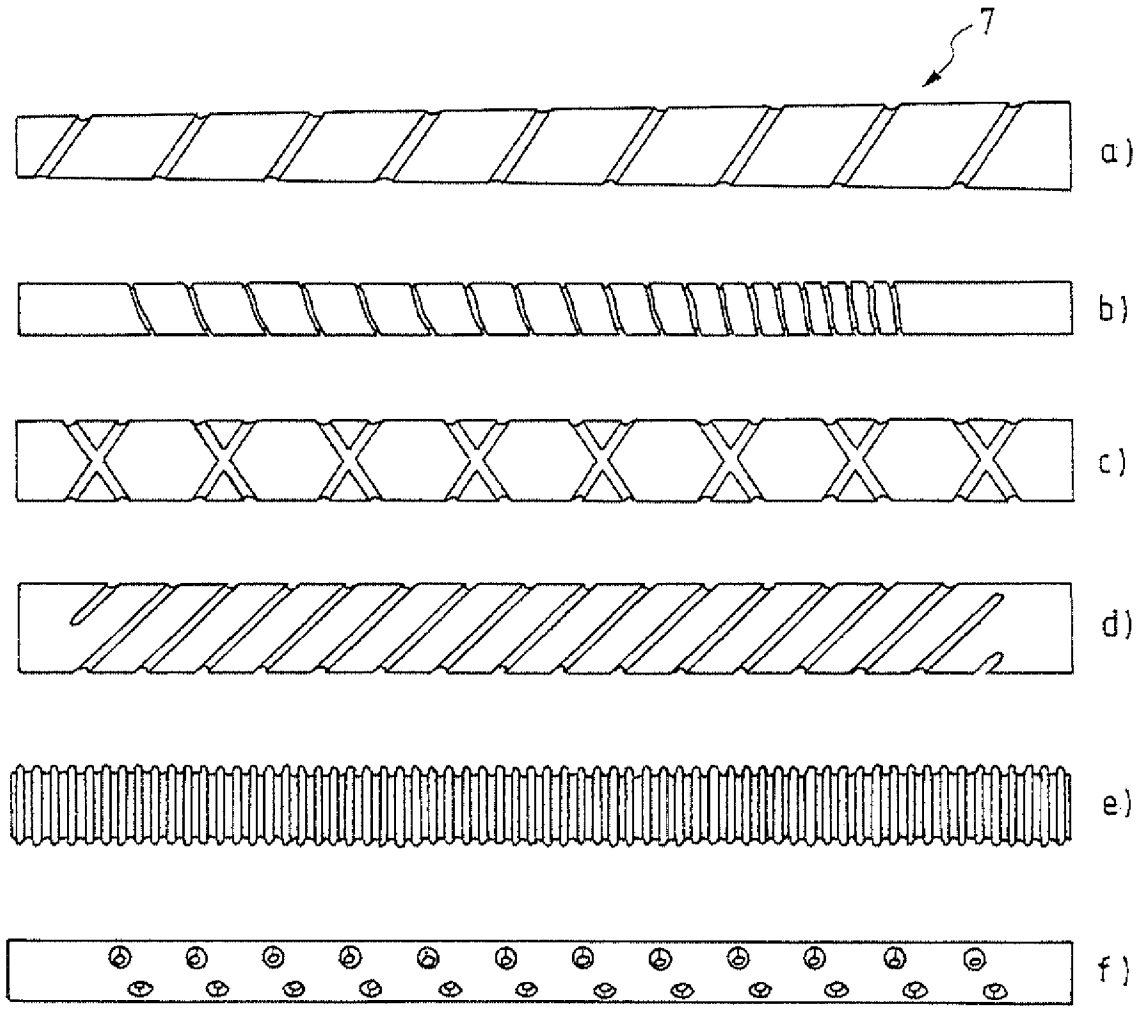
FIGS. 5*a* to 5*f* show heat exchange tubes with different surface profiles.

FIGS. 5*a* to 5*f* illustrate embodiments of surface contours of the heat exchange tubes 7 for enlargement of the heat-transferring surface. Moreover, these structures can selectively influence the flow of the coolant flowing over the surface. FIGS. 5*a* and 5*b* illustrate surfaces having a groove, respectively an indentation, which is helically wound about the longitudinal axis. While in the heat exchange tube 7 according to FIG. 5*a*, the outer diameter constantly changes and the pitch of the groove remains constant. In the embodiment according to FIG. 5*b*, the pitch of the groove changes and the outer diameter remains constant.

The surfaces of the heat exchange tubes 7 according to FIGS. 5*c* and 5*d* feature helical lines, respectively a helix. The helical lines thereby are either formed as a crossed, double, or triple helix.

In an another embodiment, the heat exchange tubes 7 can feature a corrugated surface according to FIG. 5*e* or a surface being equipped with beads, or indentations according to FIG. 5*f*.

FIGS. 6*a* to 6*d* show other embodiments of the heat exchange tubes 7 or tube bundles within the heat exchanger 1. The heat exchange tubes 7 of FIGS. 1*b* to 4*b* which are bent in an S-shape feature a first rectilinear section with an adjoining first deflection zone 12, in which the exhaust gas is deflected by 180° when flowing through the heat exchange tubes 7. A further rectilinear section adjoins the first deflection zone 12, which is in turn adjoined by the second deflection zone 13. Since both deflection zones 12, 13 each lead to a deflection of the exhaust gas flow by 180°, the exhaust gas flows into and out of the heat exchanger 1 in the same direction, this means in the longitudinal direction L. Downstream of the second deflection zone 13, the exhaust gas flows through rectilinearly formed heat exchange tubes 7 to the exhaust gas outlet 3.

Figure 6:
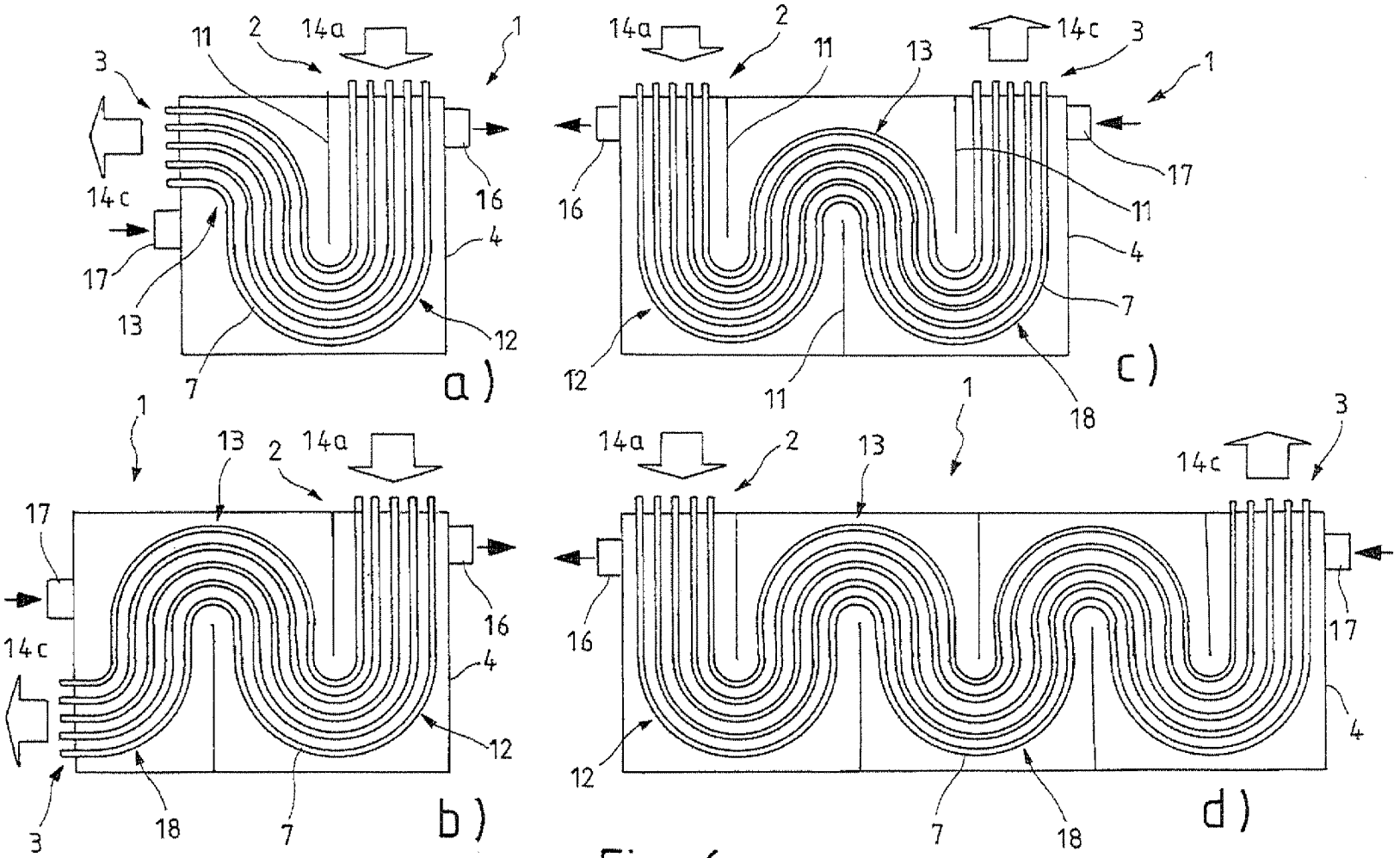
FIGS. 6*a* to 6*d* show connection options of the heat exchange tubes within the tube bundle.

According to FIG. 6*a*, the second deflection zone 13 is formed such that the exhaust gas mass flow is deflected merely by 90°. Then, following a first deflection by 180° and a second deflection by 90°, the exhaust gas exits the heat exchanger 1 in a direction of flow 14*c* which exhibits an angle of 90° with respect to the direction of a flow 14*a* of the exhaust gas flowing into the heat exchanger 1. The coolant being introduced via the coolant inlet 17 substantially in counter flow to the exhaust gas and flows out through the heat exchanger 1 and through the coolant outlet 16.

In the embodiment shown in FIG. 6*b*, a third deflection zone 18 adjoins the third rectilinearly formed section of the heat exchange tubes 7. In the third deflection zone 18, the exhaust gas mass flow experiences a deflection by 90°. The exhaust gas flows out of the heat exchanger 1 in one direction of a flow 14*c* following a first as well as a second deflection respectively by 180° and a third deflection by 90°, which equally exhibits an angle of 90° with respect to the direction of the flow 14*a* of the exhaust gas flowing through the heat exchanger 1.

In another embodiment, the third deflection zone 18 deflects the exhaust gas mass flow by 180°, as illustrated in FIG. 6*c*, the exhaust gas on the same side of the heat exchanger 1 enters through the exhaust gas inlet 2 and exits again through the exhaust gas outlet 3. However, the exhaust gas does not only experience a single deflection by 180° but is multiply deflected by means of the heat exchange tubes 7 which are bent in a W-shape.

The embodiments of the heat exchange tubes 7 and thus of the tube bundle are variable. FIG. 6*d*, for example, illustrates heat exchange tubes 7 having five deflection zones 12, 13, 18 each deflecting the exhaust gas mass flow by 180°. Each of the five deflection zones 12, 13, 18 connected to one another via rectilinear sections.

As a function of the number of deflection zones 12, 13, 18 and the angles of the deflection zones 12, 13, 18 to be respectively swept, it is determined at which angle with respect to one another the exhaust gas flows into or out of the heat exchanger 1 or at which angle the exhaust gas inlet 2 and the exhaust gas outlet 3 are aligned with respect to one another.

As a function of the direction of flow of the coolant, it is determined whether the heat exchanger 1 is operated in counter flow or in direct flow.

From the foregoing description, one ordinarily skilled in the art can easily ascertain the essential characteristics of this invention and, without departing from the spirit and scope thereof, can make various changes and modifications to the invention to adapt it to various usages and conditions.

LIST OF REFERENCE NUMERALS

1 Heat exchanger
2 Exhaust gas inlet
3 Exhaust gas outlet
5 Housing wall
5*a* Exhaust gas inlet adapter
5*a* Exhaust gas inlet heat exchanger
5*b* Exhaust gas inlet bypass
6 Exhaust gas inlet flange
7 Heat exchange tubes
8 Bypass tubes
9 Tube bottom, outlet tube bottom
10 Exhaust gas outlet adapter
11 Coolant flow directing means
12 First deflection zone, deflection
13 Second deflection zone, deflection
14*a* Flow direction of exhaust gas at exhaust gas inlet 5*a*
14*b* Flow direction of exhaust gas at exhaust gas inlet 5*b*
14*c* Flow direction of exhaust gas at exhaust gas outlet adapter 10
15 Tube bottom, inlet tube bottom
16 Coolant connection, coolant outlet
17 Coolant connection, coolant inlet
18 Third deflection zone
L Longitudinal direction, length
B Width
H Height

What is claimed is:

1. A heat exchanger for cooling an exhaust gas comprising:

a housing having a housing wall coupled to an outlet tube bottom and an inlet tube bottom, the housing forming a flow chamber for a coolant and delimiting a flow thereof, wherein the housing further includes a coolant inlet and a coolant outlet;

a plurality of heat exchange tubes disposed within the housing and configured for conveying a flow of the exhaust gas therethrough, wherein each of the plurality of heat exchange tubes includes an inlet and an outlet, the plurality of heat exchange tubes having a plurality of deflection zones and a plurality of rectilinear sections, each of the plurality of rectilinear sections disposed adjacent and in fluid communication with at least one deflection zone, wherein the plurality of deflection zones cooperates with the plurality of rectilinear sections to cause each of the heat exchange tubes to have an S-shape, the plurality of deflection zones deflecting the flow of the exhaust gas through the plurality of heat exchange tubes and the flow of the coolant within the flow chamber;

a plurality of bypass tubes disposed within the housing and configured to convey at least a portion of the flow of the exhaust gas therethrough; and at least two coolant flow directing means configured to divide the flow chamber for the coolant into at least three ducts to deflect the flow of the coolant, wherein each of the at least two coolant flow directing means is disposed between two adjacent rectilinear sections of each of the plurality of heat exchange tubes, wherein the inlet of each of the plurality of heat exchange tubes is disposed adjacent the coolant inlet and the outlet of each of the plurality of heat exchange tubes is disposed adjacent the coolant outlet and the plurality of bypass tubes.

2. The heat exchanger of claim 1, wherein the plurality of deflection zones deflect the flow of the exhaust gas through the plurality of heat exchange tubes by at least an angle of 90°.

3. The heat exchanger of claim 1, wherein the plurality of rectilinear sections and the plurality of deflection zones are one of soldered and welded to each other to form each of the plurality of heat exchange tubes into the S-shape.

4. The heat exchanger of claim 1, wherein the plurality of heat exchange tubes is bent to form the plurality of rectilinear sections and the plurality of deflection zones to form each of the plurality of heat exchange tubes into the S-shape.

5. The heat exchanger of claim 1, wherein the plurality of heat exchange tubes is formed from a metallic material.

6. The heat exchanger of claim 1, wherein each of the plurality of heat exchange tubes has an outer wall, the outer wall having a surface.

7. The heat exchanger of claim 6, wherein the surface of the outer wall of the heat exchange tubes has a groove Ruined therein, the groove helically wound in respect of a longitudinal axis of each of the plurality of heat exchange tubes.

8. The heat exchanger of claim 7, wherein a pitch of the groove is one of constant and varying along the surface of the outer wall.

9. The heat exchanger of claim 6, wherein an outer diameter of each of the plurality of heat exchange tubes is one of constant and varying along a longitudinal axis thereof.

10. The heat exchanger of claim 6, wherein the surface of the outer wall of the heat exchange tubes has one of a crossed helical line, a double helical line, and a triple helical line formed therein.

11. The heat exchanger of claim 6, wherein the surface of the outer wall of the heat exchange tubes is one of a corrugated surface and an indented surface.

12. The heat exchanger of claim 1, wherein each of the plurality of heat exchange tubes has one of substantially rectangular cross-sectional shape and a substantially circular cross-sectional shape.

13. The heat exchanger of claim 1, wherein the flow of the exhaust gas is divided between the plurality of heat exchange tubes and the plurality of bypass tubes.

14. The heat exchanger of claim 1, further comprising an exhaust gas inlet adapter coupled to the housing wall and an exhaust gas outlet adapter coupled to the housing wall, the exhaust gas inlet adaptor having a first exhaust gas inlet in fluid communication with the plurality of heat exchange tubes and a second exhaust gas inlet in fluid communication with the plurality of bypass tubes, and wherein the exhaust gas outlet adapter has an exhaust gas outlet in fluid communication with the plurality of heat exchange tubes and the plurality of bypass tubes.

15. A heat exchanger for cooling an exhaust gas comprising:

a housing having a housing wall coupled to an outlet tube bottom and an inlet tube bottom, the housing forming a flow chamber for a coolant and delimiting a flow thereof, wherein the housing further includes a coolant inlet and a coolant outlet;

a plurality of heat exchange tubes disposed within the housing and configured for conveying a flow of the exhaust gas therethrough, wherein each of the plurality of heat exchange tubes includes an inlet and an outlet, each of the plurality of heat exchange tubes being bent to form one of an S-shape and W-shape, each of the plurality of heat exchange tubes having a plurality of deflection zones coupled to a plurality of rectilinear sections, the plurality of deflection zones deflecting the flow of the exhaust gas through the plurality of heat exchange tubes and the flow of the coolant within the flow chamber;

a plurality of bypass tubes disposed within the housing adjacent the plurality of heat exchange tubes and configured for conveying at least a portion of the flow of the exhaust gas therethrough, wherein the flow of the exhaust gas is divided between the plurality of heat exchange tubes and the plurality of bypass tubes; and at least two coolant flow directing means configured to divide the flow chamber for the coolant into at least three ducts to deflect the flow of the coolant, wherein each of the at least two coolant flow directing means is disposed between two adjacent rectilinear sections of each of the plurality of heat exchange tubes, wherein the inlet of each of the plurality of heat exchange tubes is disposed adjacent the coolant inlet and the outlet of each of the plurality of heat exchange tubes is disposed adjacent the coolant outlet and the plurality of the bypass tubes.

16. The heat exchanger of claim 1, wherein the at least three ducts of the flow chamber includes a first duct formed adjacent a first side of the housing, a second duct formed adjacent a second side of the housing arranged opposite the first side thereof, and a third duct disposed between the first duct and the second duct.

17. The heat exchanger of claim 16, wherein each of the plurality of heat exchange tubes includes a first rectilinear section and a second rectilinear section, wherein the first rectilinear section of each of the plurality of heat exchange tubes is disposed in the first duct, the second rectilinear section of each of the plurality of heat exchange tubes is disposed in the second duct, and each of the plurality of bypass tubes is disposed in the second duct.

18. The heat exchanger of claim 17, wherein the coolant inlet is directly fluidly coupled to the first duct of the flow chamber and the coolant outlet is directly fluidly coupled to the second duct of the flow chamber.

* * * * *